US007379703B2

(12) United States Patent
Ito

(10) Patent No.: US 7,379,703 B2
(45) Date of Patent: May 27, 2008

(54) IMAGE FORMING APPARATUS

(75) Inventor: Terumasa Ito, Ama-gun (JP)

(73) Assignee: Brother Kogyo kabushiki Kaisha, Nagoya-shi (JP)

( * ) Notice: Subject to any disclaimer, the term of this patent is extended or adjusted under 35 U.S.C. 154(b) by 267 days.

(21) Appl. No.: 11/172,938

(22) Filed: Jul. 5, 2005

(65) Prior Publication Data

US 2006/0008305 A1 Jan. 12, 2006

(30) Foreign Application Priority Data

Jul. 6, 2004 (JP) ..... 2004-199811

(51) Int. Cl.
*G03G 15/00* (2006.01)

(52) U.S. Cl. ..... 399/406; 101/232; 492/28

(58) Field of Classification Search ..... 399/406, 399/397; 162/197; 271/161, 188; 492/28–37
See application file for complete search history.

(56) References Cited

U.S. PATENT DOCUMENTS

| | | | | |
|---|---|---|---|---|
| 4,372,176 | A | 2/1983 | Terry | |
| 4,372,549 | A * | 2/1983 | Stiernspetz | 271/23 |
| 4,890,504 | A | 1/1990 | Carrigan et al. | |
| 5,129,876 | A * | 7/1992 | Brabant et al. | 493/471 |
| 6,340,156 | B1 * | 1/2002 | Sekita | 271/270 |
| 6,439,116 | B1 * | 8/2002 | Schafer et al. | 101/350.6 |
| 6,473,592 | B2 * | 10/2002 | Nishio | 399/406 |
| 2003/0131678 | A1 * | 7/2003 | Noguchi et al. | 74/434 |
| 2005/0100366 | A1 * | 5/2005 | Kim et al. | 399/254 |

FOREIGN PATENT DOCUMENTS

| | | |
|---|---|---|
| JP | 1185685 | 7/1989 |
| JP | 6329318 | 11/1994 |
| JP | 8175733 | 7/1996 |
| JP | 9188458 | 7/1997 |
| JP | 11065192 A | 3/1999 |
| JP | 2001226015 | 8/2001 |
| JP | 2001226015 A | 8/2001 |
| JP | 2002003051 A | 1/2002 |
| JP | 2003117984 A | 4/2003 |
| JP | 2004018252 A | 1/2004 |

OTHER PUBLICATIONS

JP Patent Application 2004-199811 "Notification of Reasons for Refusal" dispatch date Oct. 11, 2007.

* cited by examiner

*Primary Examiner*—Judy Nguyen
*Assistant Examiner*—Andy L Pham
(74) *Attorney, Agent, or Firm*—Banner & Witcoff, Ltd.

(57) ABSTRACT

A plurality of helical groove sections are provided on outer peripheral surfaces of press rollers provided in a curl elimination mechanism. Each of the groove sections assumes a shape extending in the circumferential direction of the respective press rollers; that is, a direction oblique to a transport direction of paper. Hence, when compared with a case where the groove sections are aligned in the transport direction of the paper, the paper is less susceptible to traces of the groove sections. Since the groove sections are provided on the press rollers, an attempt can be made to enhance dimensional accuracy of or reduce the weight of the press rollers.

27 Claims, 8 Drawing Sheets

IMAGE FORMING APPARATUS

BACKGROUND OF THE INVENTION

1. Field of the Invention

The present invention relates to an image forming apparatus, such as a laser printer or the like.

2. Description of the Related Art

An image forming apparatus using electrophotography, such as a copier or a laser printer, has hitherto adopted a heat-roller-type fuser which transports a sheet material having an unfixed toner image formed thereon while heating the sheet material, to thus fix a toner image. In such an image forming apparatus, a curl arises during the course of the sheet material passing through the fuser, which may exert an adverse effect, such as deterioration of ease of stacking of sheet materials on an output tray. For this reason, as described in JP-A-9-188458 which will be described below, an image forming apparatus equipped with a curl elimination mechanism for straightening a curl of a sheet material has already been put into practice. This curl elimination mechanism is disposed downstream of the fuser and includes a curl-straightening roller to be rotationally driven and a pair of press rollers which oppose the curl-straightening roller and are rotationally driven so as to follow the curl-straightening roller. Grooves are formed in a circumferential direction in the outer peripheral surfaces of the respective press rollers. The sheet material is transported along an outer peripheral surface of the curl-straightening roller while being nipped between three rollers, whereby the sheet material is curled in a direction opposite that in which the sheet material has been curled by the fusing means, to thus eliminate the curl.

SUMMARY OF THE INVENTION

In addition to rollers made of rubber, rollers made of synthetic resin are commonly used as rollers to be used for transporting a sheet material. The rollers made of synthetic resin are usually formed by injection molding. However, when the rollers are formed through injection molding, the rollers are preferably built-up, in order to ensure dimensional accuracy. A conceivable specific configuration for performing build up is forming a plurality of groove sections 101 in an outer peripheral surface of a roller 100 in a circumferential direction as is done by a press roller described in JP-A-9-188458 (see FIG. 8A). Even when there is no necessity for build-up, such as a case where a roller is formed from another material such as metal or where a roller is formed by a method other than injection molding, there may arise a case where groove sections having an analogous form are formed in an outer peripheral surface of the roller with a view toward weight reduction or the like.

In the previously-described curl elimination mechanism, in order to effectively eliminate a curl having arisen in a sheet material, a nipping pressure developing between rollers is desirably set to a sufficiently large value. However, when groove sections are circumferentially formed in the rollers having the curl elimination mechanism, as shown in FIG. 8B, if the nipping pressure is high, there arises a problem of traces 103 oriented in the transport direction of the sheet material being formed in the sheet material 102 by the groove sections when the sheet material is pressed against the outer peripheral surfaces of the rollers.

The present invention has been completed under the circumstances such as those mentioned previously and aims at providing an image forming apparatus capable of preventing formation of traces in a sheet material, which would otherwise be caused by rollers.

According to one aspect of the invention, there is provided with an image forming apparatus having a roller which rotates around a shaft thereof to thus transport a sheet material contacting an outer peripheral surface of the roller. The roller is formed from a grooved roller having groove sections which extend in a direction oblique to a circumferential direction and are formed in an outer peripheral surface of the roller.

According to the above-aspect of the invention, the groove sections formed in the outer peripheral surface of the grooved roller assume the shape which extends in a circumferential direction; that is, a direction oblique to the transport direction of the sheet material. By this shape, the groove sections become less likely to leave traces on the sheet material as compared with groove sections which are arranged in line with the transport direction of the sheet material. Moreover, an attempt can be made to enhance dimensional accuracy of rollers or reduce the weight of the same.

According to another aspect of the invention, the grooved roller is formed from synthetic resin.

Since the grooved roller is made of synthetic resin, the roller can be manufactured inexpensively.

According to another aspect of the invention, the grooved roller is formed by injection molding.

Since the grooved roller is formed by injection molding, the roller can be manufactured less expensively than in the case where the roller is formed by another method, such as cutting or powder molding. Moreover, the groove sections play the role of built-up areas, and hence dimensional accuracy can be ensured.

According to another aspect of the invention, the groove sections are always given a shape which does not extend over the entire circumference of a cross sectional profile of the grooved roller which is orthogonal to the axis.

According to the above-aspects of the invention, when a cross sectional profile orthogonal to the axis of the grooved roller is viewed, the groove sections do not extend over the entire circumference of the roller. Therefore, an area which inevitably comes into contact with the sheet material exists in the outer periphery of the roller. Accordingly, occurrence of a wrinkle in the transport direction of the sheet material can be prevented without fail.

According to another aspect of the invention, the groove sections are formed into a substantially helical shape centered about the axis.

Since the groove sections are substantially formed in a helical shape, the sheet material is smoothly transported as compared with, e.g., a case where the sheet material is transported by a meandering groove section.

According to another aspect of the invention, the grooved roller is provided in numbers side by side in a transverse direction of the sheet material. The groove sections of the grooved rollers are arranged on both sides in a pattern symmetrical about a center axis with respect to a transverse direction of the sheet material.

Since groove sections belonging to the plurality of grooved rollers arranged side by side in the transverse direction of the sheet material are arranged on both sides of a pattern symmetrical about the center axis of the sheet material with respect to the transverse direction thereof. Hence, the forces exerted on both sides of the sheet material from the grooved roller become uniform, whereby the sheet material is reliably transported while being straightened.

According to another aspect of the invention, the groove sections are provided so as to head further outside in relation to the transverse direction of the sheet material with increasing proximity to an upstream in a direction in which the sheet is transported.

The groove sections assume a shape which heads further outside in relation to the transverse direction of the sheet material with increasing proximity to an upstream in the transport direction of the sheet material. Therefore, occurrence of wrinkles in the center of the sheet material can be prevented reliably.

According to another aspect of the invention, the image forming apparatus further includes a curl elimination mechanism for eliminating a curl having arisen in the sheet material. At least some of the rollers belonging to the curl elimination mechanism are formed from the grooved roller.

Since the curl elimination mechanism makes full use of curl elimination function, the force exerted on the sheet material from the roller generally becomes greater than that exerted by another transport mechanism. However, a great effect can be acquired by applying the grooved roller to such a curl elimination mechanism.

According to another aspect of the invention, the curl elimination mechanism includes a curl-straightening roller to be rotationally driven; and a pair of press rollers which are disposed opposite the curl-straightening roller and arranged so as to be respectively rotatable about different axes for transporting the sheet material along an outer peripheral surface of the curl-straightening roller while the sheet material is nipped between the curl-straightening roller and the pair of press rollers. The pair of press rollers are formed from the grooved roller. The groove sections of both press rollers are formed so as to be oriented in the same direction in relation to the sheet material.

According to the above-aspects of the invention, the pair of grooved rollers opposing the curl-straightening roller are formed so as to be oriented in the same direction in relation to the sheet material of the groove section. Hence, the sheet material is less susceptible to stress between the press rollers, and the sheet material can be transported more smoothly.

According to another aspect of the invention, the curl elimination mechanism includes: a curl-straightening roller to be rotationally driven; a pair of press rollers which are disposed opposite the curl-straightening roller and which transport the sheet material along an outer peripheral surface of the curl-straightening roller while the sheet material is nipped between the curl-straightening roller and the pair of press rollers; a holder which retains the pair of press rollers and can be displaced in such a direction as to cause the press rollers to approach or depart from the curl-straightening roller; a spring member for impelling the holder in such a direction that the press rollers approach the curl-straightening roller; and a stopper capable of regulating displacement of the holder in excess of a predetermined range in a direction in which the press rollers depart from the curl-straightening roller.

In a case where a curl having arisen in a firm sheet material, such as cardboard, is straightened, if the press rollers are excessively departed from the curl-straightening roller, the curl cannot be eliminated effectively. Conversely, if the impelling force of the spring member is set high in order to prevent occurrence of such a problem, excessive stress will be exerted on a less-firm sheet material. In contrast, by the present configuration, when displacement of the holder retaining the press rollers has reached a predetermined level, further displacement will be regulated by the stopper. Therefore, even when the impelling force of the spring member is not made greater, the curl in the less weak sheet material can be straightened. Accordingly, the impelling force of the spring material is suppressed to a small level, and the stress exerted on the less-firm sheet material can be lessened.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

An embodiment of the present invention will now be described by reference to FIGS. 1 through 7.

Figure 1:
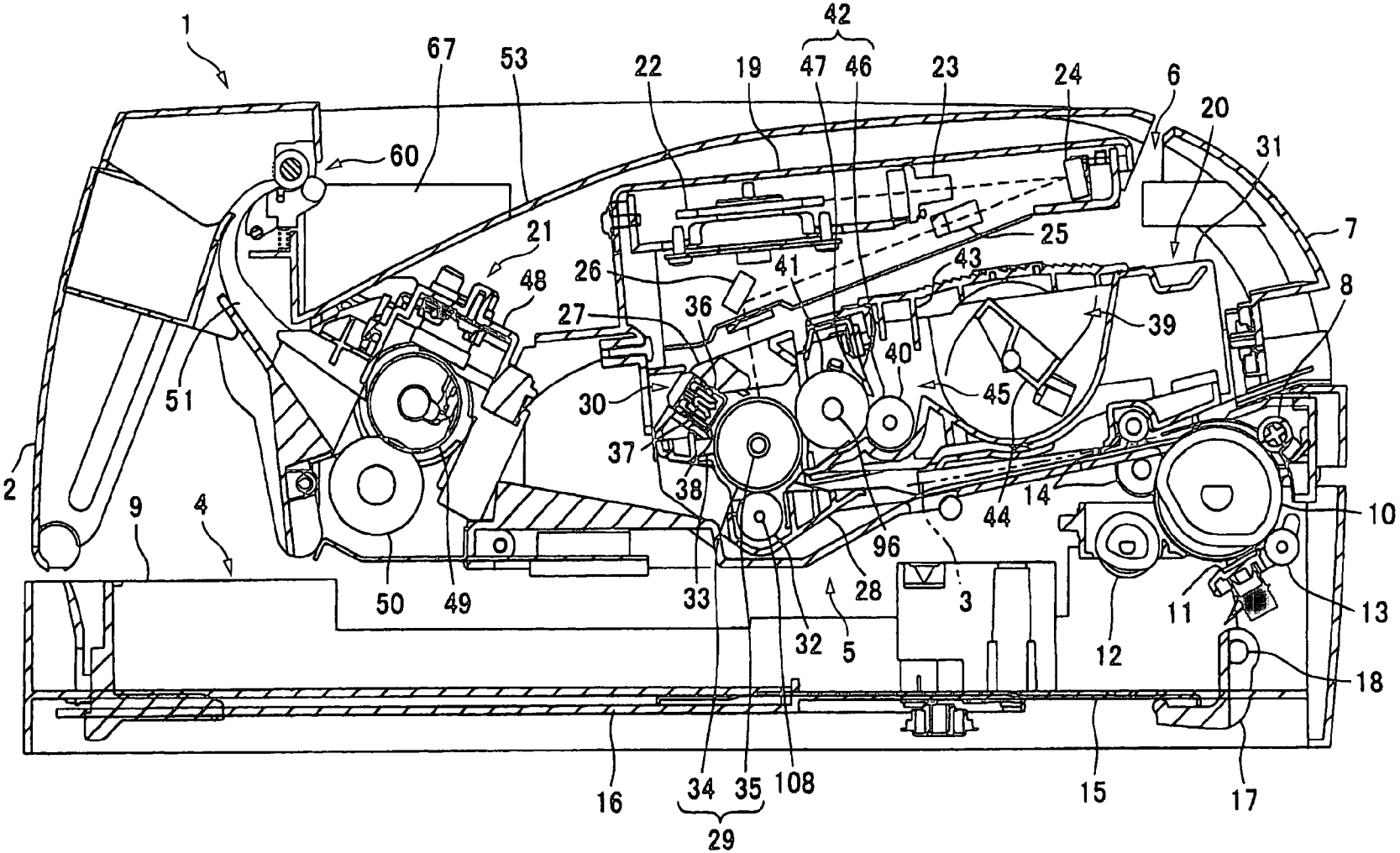
FIG. 1 is a side cross-sectional view of a principal section, showing an image forming apparatus according to an embodiment of the present invention.

FIG. 1 is a side cross-sectional profile of the principal section, showing a laser printer serving as an image forming apparatus of the present invention. The laser printer 1 comprises a main body casing 2; a feeder section 4 for feeding paper 3 (corresponding to a "sheet material" of the embodiment of the present invention) which is to be housed in the main body casing 2 and serves as a transfer medium; and an image formation section 5 for forming an image on the fed paper 3.

An attachment-and-detachment port 6 used for attaching or detaching a process cartridge 20 to be described later is formed in one side wall of the main body casing 2. A front cover 7 for opening and closing the attachment-and-detachment port 6 is provided on the side wall. The front cover 7 is pivotally supported by a cover shaft (not shown) inserted into a lower end portion of the front cover. When the front cover 7 is closed about a cover axis, the attachment-and-detachment port 6 is closed by the front cover 7 as shown in FIG. 1. When the front cover 7 is opened (inclined) while the cover axis is taken as a fulcrum, the attachment-and-detachment port 6 is opened. The process cartridge 20 can be removably attached to the main body casing 2 by way of the attachment-and-detachment port 6.

In the following description, in a state where the process cartridge 20 is attached to the main body casing 2, the part of the laser print 1 where the front cover 7 is provided is taken as a "front side," and the opposite part of the same is taken as a "rear side."

The feeder section 4 comprises a paper feed tray 9 removably attached to an internal bottom of the main body casing 2; a paper feed roller 10 and a separation pad 11 which are provided at upper positions on the front end of the paper feed tray 9; a pickup roller 12 provided on a rear part of the paper feed roller 10; a pinch roller 13 provided at a lower forward position opposite the paper feed roller 10; a paper dust removal roller 8 provided at a higher forward position opposite the paper feed roller 10; and a registration roller 14 disposed at a higher position rearward of the paper feed roller 10.

A paper press plate 15 which enables layered stacking of the paper 3 is provided within the paper feed tray 9. A rear end portion of the paper press plate 15 is supported in a pivotable manner. As a result, the paper press plate 15 is pivotable between a load position where a front edge of the paper press plate is situated at a low position in alignment with a bottom plate 16 of the paper feed tray 9 and a transport position where a front edge of the same is situated at a higher position and inclined.

A lever 17 for raising the front edge of the paper press plate 15 upward is provided at a front edge portion of the paper tray 9. The lever 17 is formed to thus assume a substantially-L-shaped cross-sectional profile so as to wrap around the lower side of the paper press plate 15 from the front side thereof. The upper end portion of the lever 17 is attached to a lever shaft 18 provided at the front end portion of the paper feed tray 9, and the rear end portion of the same remains in contact with the front edge portion of the lower surface of the paper press plate 15. As a result, when clockwise rotational driving force is input to the lever shaft 18, the lever 17 is rotated while taking the lever shaft 18 as a fulcrum, whereupon the rear end portion of the lever 17 raises the front edge portion of the paper press plate 15, to thus position the paper press plate 15 in the transport position.

When the paper press plate 15 is situated at the transport position, the paper 3 on the paper press plate 15 is pressed by the pickup roller 12. By rotation of the pickup roller 12, the paper 3 starts being transported between the paper feed roller 10 and the separation pad 11.

When the paper feed tray 9 is detached from the main body casing 2, the front end portion of the paper press plate 15 moves downward under its own weight, so that the paper press plate 15 is placed at the loading position. When the paper press plate 15 is situated at the loading position, the paper 3 can be placed on the paper press plate 15 in a stacked manner.

When the paper 3 fed between the paper feed roller 10 and the separation pad 11 by the pickup roller 12 is nipped between the paper feed roller 10 and the separation pad 11 by rotation of the paper feed roller 10, the paper is picked up one sheet at a time without fail and fed. The thus-fed paper 3 passes between the paper feed roller 10 and the pinch roller 13, and is transported to the registration roller 14 after paper dust has been removed from the paper by the paper dust removal roller 8.

The registration roller 14 is formed from a pair of rollers. After having registered the paper 3, the registration roller 14 transports the paper 3 to a transfer position which is located between a photosensitive drum 29 and a transfer roller 32, both of which will be described later, and where a toner image on a photosensitive drum 29 is to be transferred onto the paper 3.

The image forming section 5 comprises a scanner section 19, the process cartridge 20, a fusing section 21, and the like.

The scanner section 19 is provided at an upper area in the main body casing 2 and comprises an unillustrated laser light source, a polygon mirror 22 to be rotationally driven, an fθ lens 23, a reflection mirror 24, a lens 25, and a reflection mirror 26. A laser beam based on image data emitted from the laser light source is deflected by the polygon mirror 22, as indicated by a chain line. After the laser beam has passed through the fθ lens 23, an optical path of the laser beam is bent by the reflection mirror 24. After the laser beam has further passed through the lens 25, the optical path of the laser beam is bent downward by the reflection mirror 26, whereupon the laser beam is radiated on the surface of the photosensitive drum 29, which will be described later, of process cartridge 20.

The process cartridge 20 is removably attached to the main body casing 2 at a position below the scanner section 19. This process cartridge 20 comprises, as a housing, an upper frame 27 serving as a first frame and a lower frame 28 which is formed separately from the upper frame 27 and serves as a second frame to be used in combination with the upper frame 27. The process cartridge 20 comprises, in the housing, the photosensitive drum 29 serving as an image carrier, a scorotoron-type electrification device 30 serving as electrification means, a development cartridge 31, the transfer roller 32 serving as transfer means, and a cleaning brush 33.

The photosensitive drum 29 comprises a drum main body 34 which assumes a cylindrical shape and is formed from a photosensitive layer which has a positive charging characteristic and whose outermost surface layer is formed from polycarbonate; and a metal drum shaft 35 serving as a shaft which extends in the shaft center of the drum main body 34 in a longitudinal direction thereof. The drum shaft 35 is supported by the upper frame 27, and the drum main body 34 is supported so as to be rotatable about the drum shaft 35. Thereby, the photosensitive drum 29 is supported by the upper frame 27 so as to be rotatable about the center of the drum shaft 35.

The scorotoron-type electrification device 30 is supported by the upper frame 27 and disposed opposite the photosensitive drum 29 at an upper rear position with respect to the photosensitive drum 29 while being spaced a predetermined interval therefrom so as not to come into contact the photosensitive drum 29. The scorotoron-type electrification device 30 comprises a discharge wire 37 disposed opposite the photosensitive drum 29 while being axially spaced a predetermined interval from the same, and a grid 38 which is interposed between the discharge wire 37 and the photosensitive drum 29 and which controls the amount of electric charge emitted from the discharge wire 37 to the photosensitive drum 29. Concurrently with application of a bias voltage to the grid 38, the scorotoron-type electrification device 30 applies a high-voltage to the discharge wire 37, to thus cause the discharge wire 37 to effect corona discharge, whereby the surface of the photosensitive drum 29 can be uniformly, positively electrified.

This scorotoron-type electrification device 30 is equipped with a cleaning member 36 for cleaning the discharge wire 37 such that the discharge wire 37 is caught by the cleaning member 36.

The development cartridge 31 is formed into a box shape whose rear portion is to be opened, and is removably attached to the lower frame 28. A toner storage chamber 39, a supply roller 40, a development roller 41, and a layer thickness regulation blade 42 are provided within the development cartridge 31.

The toner storage chamber 39 is formed into a front internal space of the development cartridge 31 partitioned by a partition plate 43. The toner storage chamber 39 is filled with, as a developing agent, nonmagnetic one-component toner having a positive charging characteristic. Polymeric monomer; e.g., polymer toner generated by copolymerization of styrene-based monomer such as styrene and acrylic monomer such as an acrylic acid, alkyl (C1 to C4) acrylate, or alkyl (C1 to C4) meta-acrylate, through suspension polymerization, is used as the one-component toner. Such polymer toner assumes a substantially spherical shape, exhibits superior fluidity, and enables formation of an image of high image quality.

Such toner is mixed with a coloring agent such as carbon black or wax. In order to enhance fluidity, external additives such as silica are added to the toner. A mean particle size of toner is about 6 to 10 μm.

An agitator 44 is provided in the toner storage chamber 39. The toner stored in the toner storage chamber 39 is agitated by the agitator 44, whereby the toner is discharged toward the supply roller 40 from an opening section 45 which is longitudinally in mutual communication with the toner storage chamber 39 at a position below the partition plate 43.

The supply roller 40 is disposed at the rear of the opening section 45 and rotatably supported by the development cartridge 31. This supply roller 40 is formed by coating a metal roller shaft with a roller made of a conductive foaming material. The supply roller 40 is rotationally driven by an input of power from an unillustrated motor.

The development roller 41 is rotatably supported by the development cartridge 31 at the rear of the supply roller 40 while remaining in compressed contact with the supply roller 40. The development roller 41 opposes and contacts the photosensitive drum 29 while the development cartridge 31 is attached to the lower frame 28. This development roller 41 is formed by coating a metal roller shaft 96 with a roller made of a conductive rubber material. Both end portions of the roller shaft 96 project, at the front end portion of the development cartridge 31, outwardly from side surfaces of the development cartridge 31 in a transverse direction orthogonal to the longitudinal direction. The roller of the development roller 41 is formed by coating the surface of a roller main body made of conductive urethane rubber or silicon rubber containing carbon particles, with a coat layer made of fluorine-containing conductive urethane rubber or silicon rubber. During development operation, a development bias is applied to the development roller 41. The development roller 41 is rotationally driven in the same direction as is the supply roller 40, by an input of power from the unillustrated motor.

The layer thickness regulation blade 42 has a press section 47 which is made of insulating silicon rubber, assumes a semi-circular cross-sectional profile, and is provided at the tip end portion of a blade main body 46 made of a metal leaf spring material. This layer thickness regulation blade 42 is supported by the development cartridge 31 at a position above the development roller 41, and the press section 47 is held in intimate contact with the development roller 41 by elastic force of the blade main body 46.

The toner discharged from the opening section 45 is supplied to the development roller 41 by rotation of the supply roller 40. At this time, the toner is positively electrified between the supply roller 40 and the development roller 41 by frictional electrification. The toner supplied over the development roller 41 enters between the press section 47 of the layer thickness regulation blade 42 and the development roller 41 in association with rotation of development roller 41, and is applied over the development roller 41 in the form of a thin layer of given thickness.

The transfer roller 32 is rotatably supported by the lower frame 28 and arranged so as to oppose and contact the photosensitive drum 29 with respect to the vertical direction when the upper frame 27 and the lower frame 28 are combined together, to thus form a nip between the transfer roller 32 and the photosensitive drum 29. This transfer roller 32 is formed by coating a metal roller shaft 108 with a roller made of a conductive rubber material. During transfer operation, a transfer bias is applied to the transfer roller 32. The transfer roller 32 is rotationally driven in a direction opposite that of the photosensitive drum 29 by an input of power from the unillustrated motor.

The cleaning brush 33 is attached to the lower frame 28 and arranged so as to oppose and contact the photosensitive drum 29 at the rear of the same while the upper frame 27 and the lower frame 28 are combined together.

After having been uniformly, positively electrified by the scorotoron-type electrification device 30 in association with rotation of the photosensitive drum 29, the surface of the photosensitive drum 29 is exposed to a laser beam output from the scanner section 19 at high speed, whereby an electrostatic latent image corresponding to an image to be formed on the paper 3 is formed.

Next, when the positively-charged toner adhering to the development roller 41 opposes and comes into contact with the photosensitive drum 29 by rotation of the development roller 41, the toner is supplied to the electrostatic latent image formed on the surface of the photosensitive drum 29; that is, areas of the uniformly, positively charged surface of the photosensitive drum 29 whose potential has decreased upon exposure to the laser beam. As a result, the electrostatic latent image of the photosensitive drum 29 is made visible, and a toner image formed through reversal development is held on the surface of the photosensitive drum 29.

Subsequently, as shown in FIG. 1, the toner image placed on the surface of the photosensitive drum 29 is transferred to the paper 3 by the transfer bias applied to the transfer roller 32 during the course of the paper 3 transferred by the registration roller 14 passing by the transfer position located between the photosensitive drum 29 and the transfer roller 32. The paper 3 on which the toner image has been transferred is transported to the fusing section 21.

Transfer residual toner still remaining on the photosensitive drum 29 after transfer operation is recovered by the development roller 41. Paper dust which has originated from the paper 3 and is affixed to the photosensitive drum 29 after transfer operation is recovered by the cleaning brush 33.

The fusing section 21 is disposed on the rear of the process cartridge 20 and comprises a fusing frame 48, and a heating roller 49 and a press roller 50, both of which are provided in the fusing frame 48.

The heating roller 49 comprises a metal tube coated with fluorine resin, and a halogen lamp provided in the metal tube for heating purpose. The heating roller 49 is rotationally driven by an input of power from the unillustrated motor.

The press roller 50 is disposed at a position below the heating roller 49 and opposite the same so as to press the heating roller 49. This press roller 50 is formed by coating a metal roller shaft with a roller made of a rubber material. The press roller 50 is rotationally driven so as to follow the heat roller 49.

During the course of the paper 3 passing between the heating roller 49 and the press roller 50, the fusing section 21 thermally fuses the toner transferred on the paper 3 at the transfer position. The paper 3 with the toner fused thereto is transported to a paper output path 51 which extends toward the upper surface of the main body casing 2 while being curved so as to assume a substantially U-shaped cross sectional profile. The paper 3 transported to the paper output path 51 passes through the curl elimination mechanism 60 provided at the upper end of the paper output path 51, and is output to the paper output tray 53 formed on the upper surface of the main body casing 2.

Figure 2:
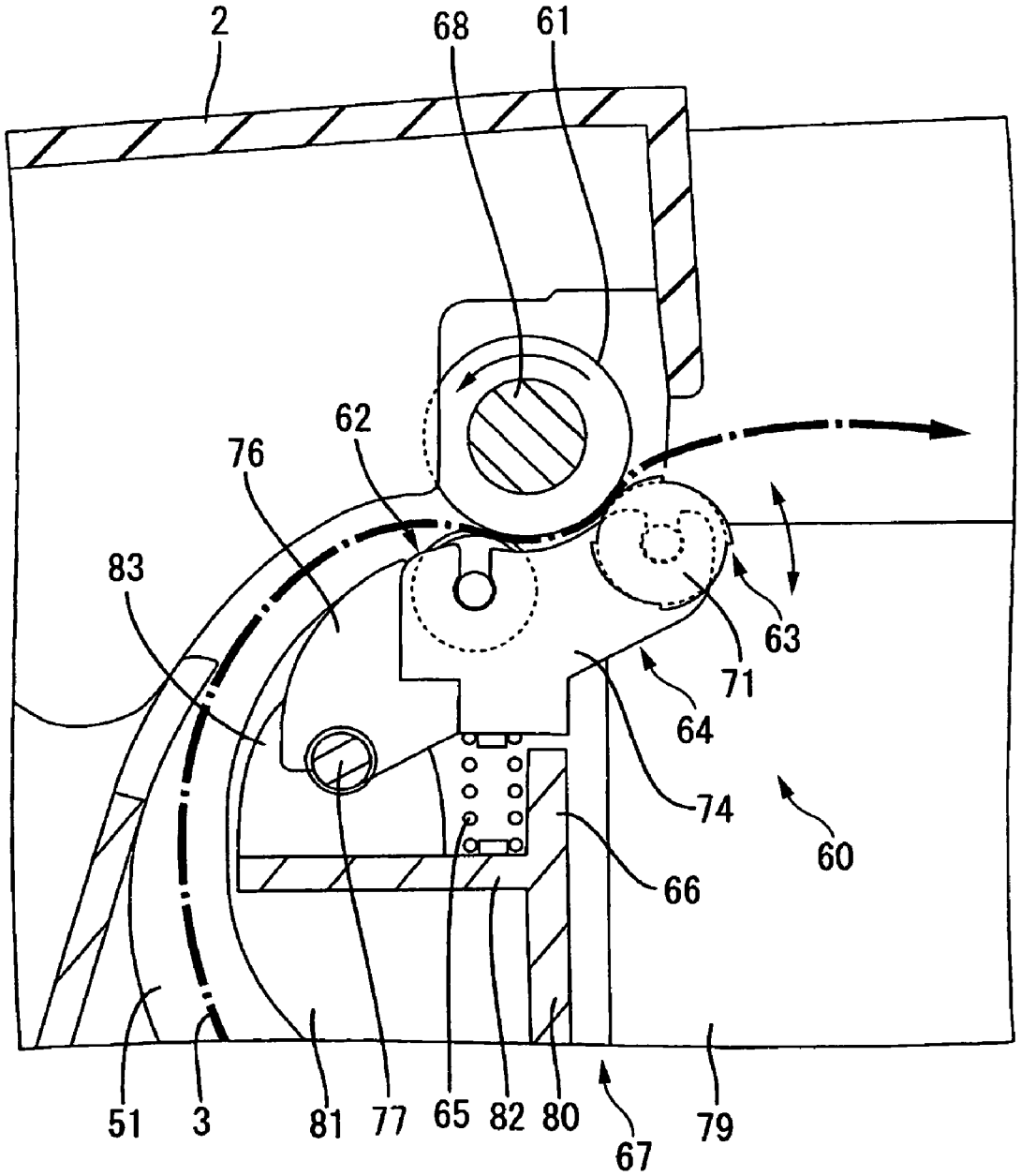
FIG. 2 is aside cross-sectional view of a curl elimination mechanism.

The configuration of the curl elimination mechanism 60 will now be described. FIG. 2 is an enlarged cross-sectional view of the neighborhood of the curl elimination mechanism 60 shown in FIG. 1.

The curl elimination mechanism 60 comprises a curl-straightening roller 61 to be rotationally driven; a pair of press rollers 62, 63 (corresponding to the "grooved roller" of the embodiment of the present invention) which are disposed opposite the curl-straightening roller 61 and so as to be rotatable about respective different axes; a holder 64 which retains the press rollers 62, 63 and can be rotationally displaced; a spring member 65 for impelling the holder 64 in a direction in which the press rollers 62, 63 approach the curl-straightening roller 61; and a stopper 66 capable of regulating displacement of the holder 64 in a direction in which the press rollers 62, 63 depart from the curl-straightening roller 61.

Figure 3:
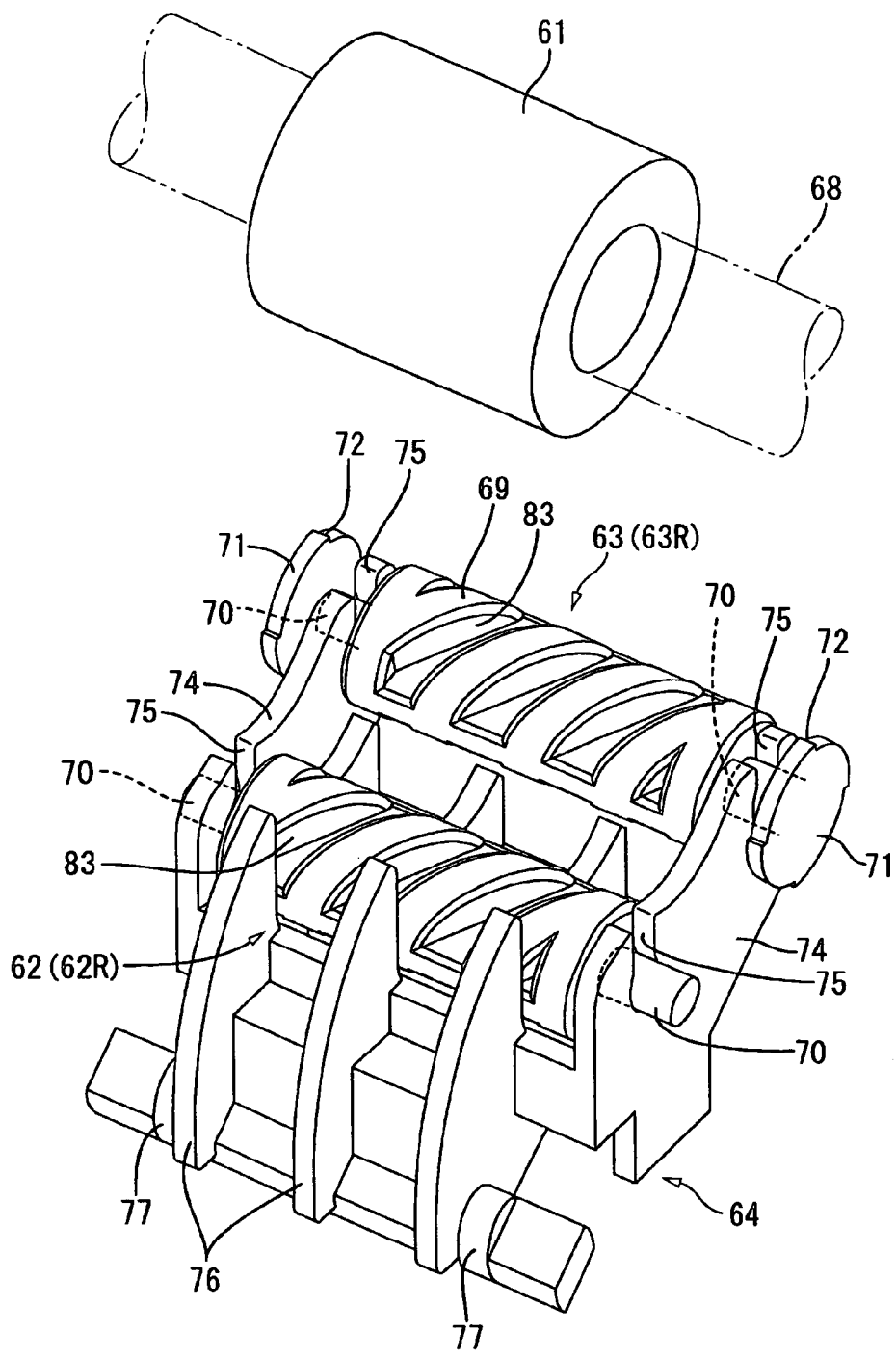
FIG. 3 is a perspective view showing a curl-straightening roller, first and second press rollers, and a holder.
Figure 4:
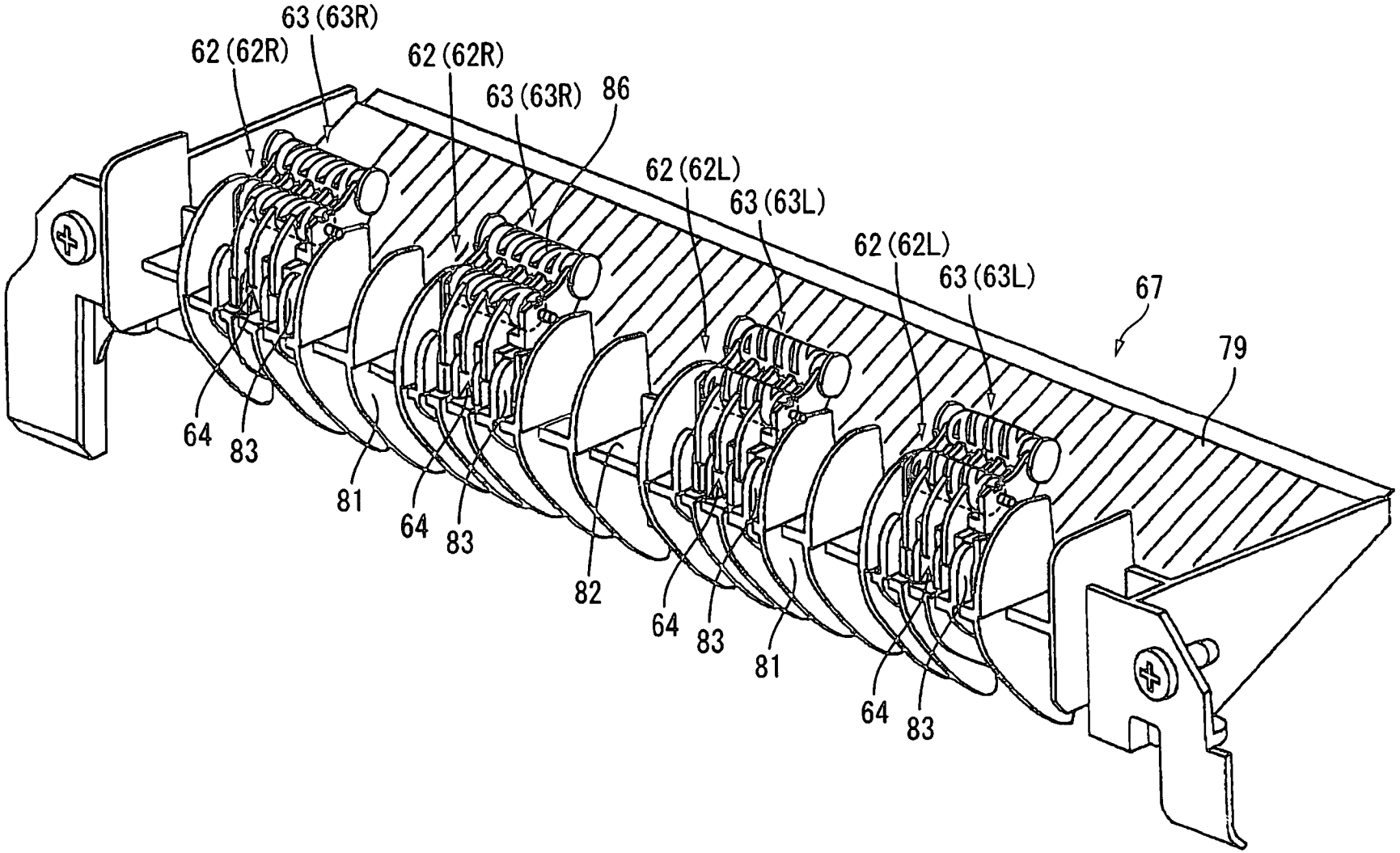
FIG. 4 is a perspective view showing that a holder and the first and second press rollers are attached to a paper output frame.
Figure 5A:
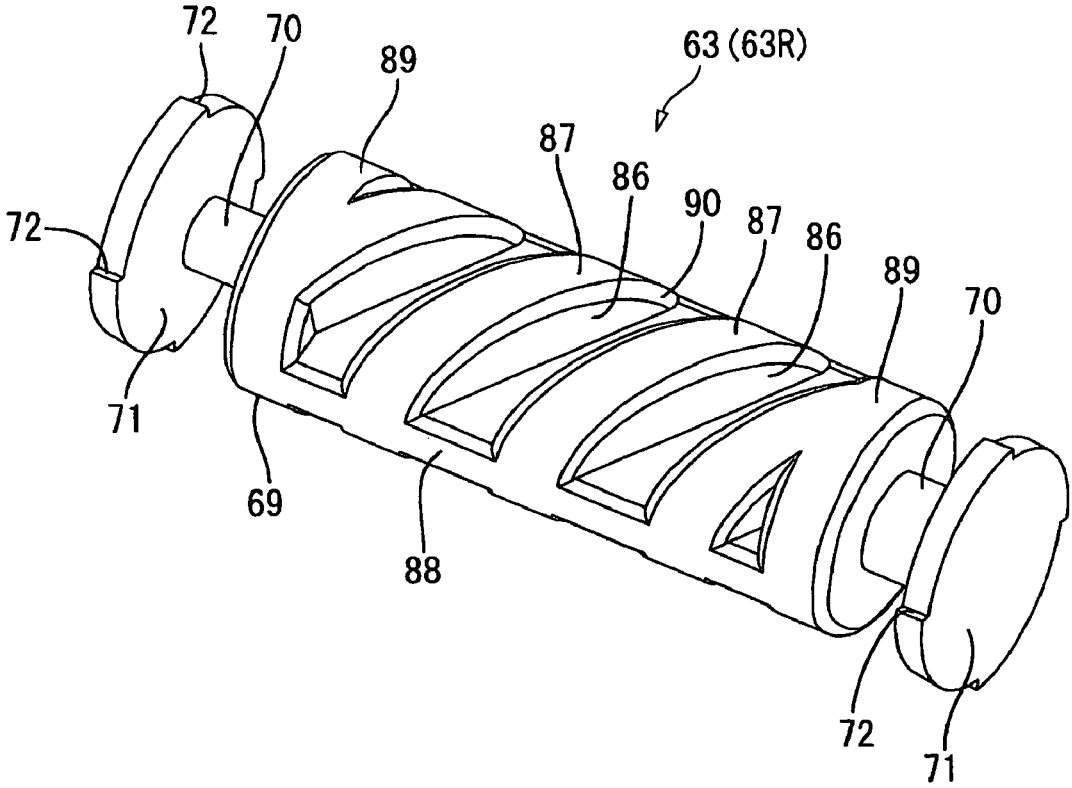
FIG. 5A is a perspective view of the second press roller.
Figure 5B:
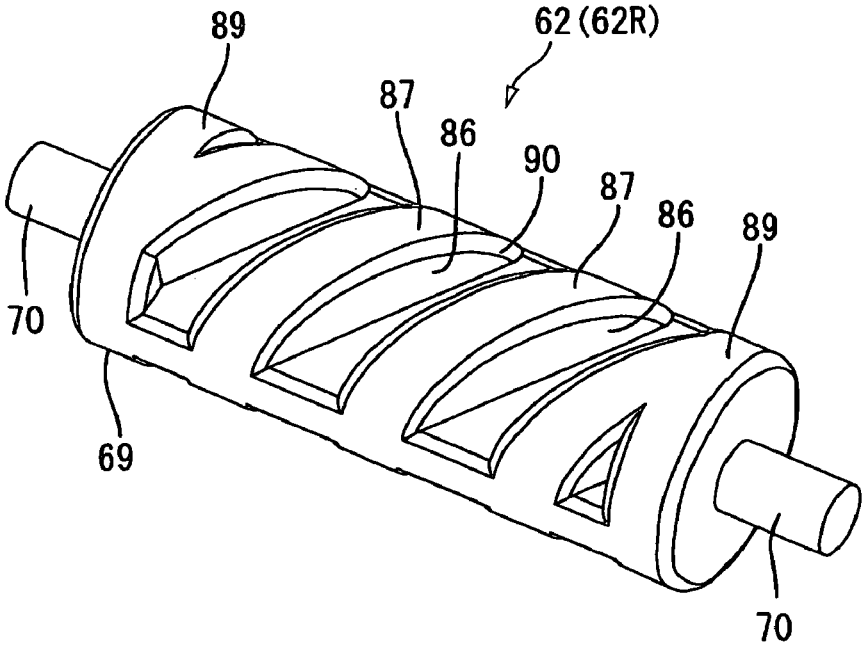
FIG. 5B is a perspective view of the first press roller.
Figure 6A:
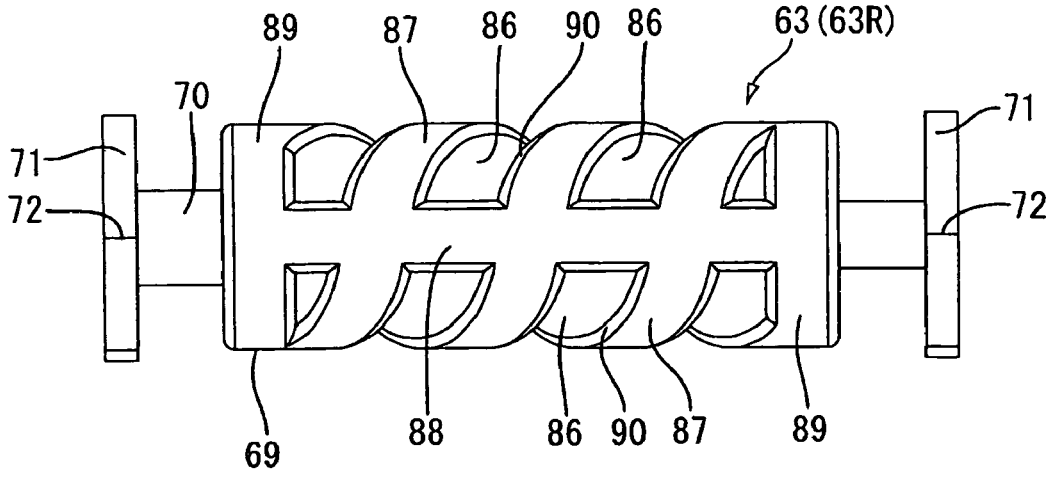
FIG. 6A is a front view of the second press roller.
Figure 6B:
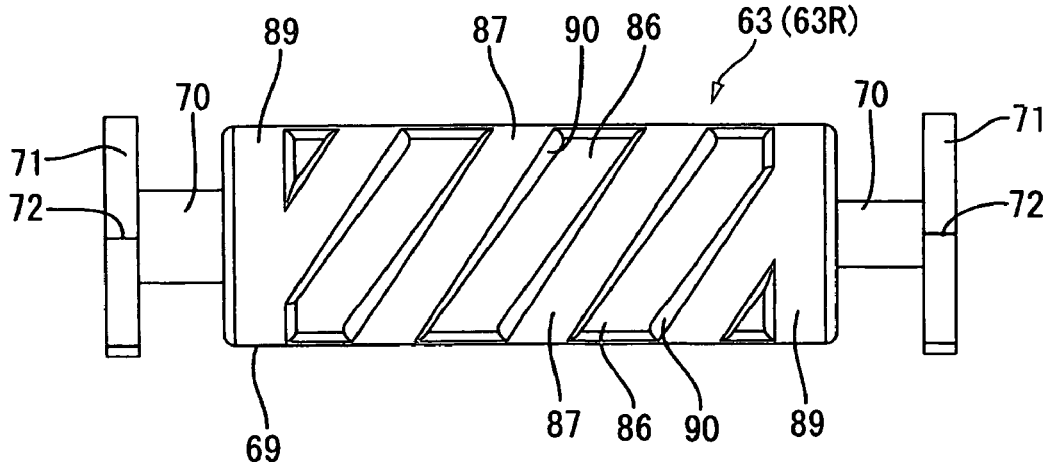
FIG. 6B is a plan view of the same.
Figure 6C:
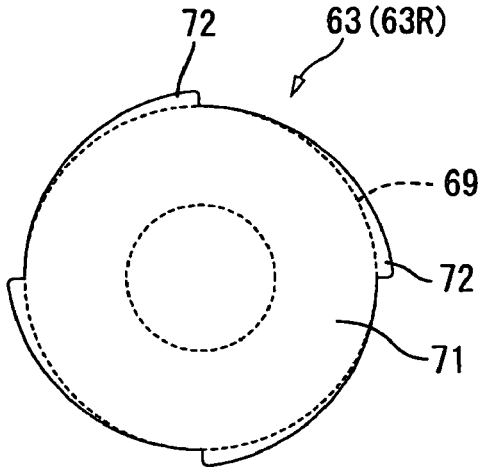
FIG. 6C is a side view of the same.

FIG. 3 is a perspective view showing the curl-straightening rollers 61 belonging to the curl elimination mechanism 60; a pair of press rollers 62, 63 opposing the curl-straightening roller 61, and a holder 64 retaining the press rollers 62, 63. For convenience of description, the drawing shows the curl-straightening roller 61 and the holder 64 as being separated from each other. FIG. 4 is a perspective view showing that the holder 64 is set to the paper output frame 67 fixed to the main body casing 2. FIG. 5A is a perspective view of the second press roller 63, and FIG. 5B is a perspective view of the first press roller 62. FIG. 6A is a front view of the second press roller 63; FIG. 6B is a plan view of the same; and FIG. 6C is a side view of the same.

As shown in FIGS. 2 and 3, the curl-straightening roller 61 is a rubber-made roller attached to one shaft 68 extending in a direction orthogonal to the feed direction of the paper 3. The curl-straightening roller 61 is rotationally driven by an input of power to the shaft 68 from the unillustrated motor. Moreover, two curl-straightening rollers 61 are provided on respective sides symmetrical with respect to the center of the transverse direction of the paper 3 (coinciding with the center of the transverse direction of the paper output tray 53).

The pair of press rollers 62, 63 are provided opposite each other for each curl-straightening roller 61. Of the pair of press rollers 62, 63, a press roller disposed upstream of the paper transport direction is called a first press roller 62, and a press roller disposed downstream of the first press roller 62 is called a second press roller 63. The respective press rollers 62, 63 are made of synthetic resin by injection molding. Each of the press rollers 62, 63 has a substantially columnar press section 69 for pressing the paper 3 against the curl-straightening roller 61, and a pair of shaft sections 70 extending from the respective axial end faces of the press section 69. As a result of both shaft sections 70 being supported by the holder 64, the press rollers 62, 63 are rotatable in a following manner while taking, as an axis, a direction orthogonal to the transport direction of the paper 3. The outer diameter of the press section 69 is smaller than the outer diameter of the curl-straightening roller 61, and the length of the press section 69 is made longer than the length of the curl-straightening roller 61. A plurality of groove sections 86, which will be described in detail later, are formed on an outer peripheral surface of the press section 69. A disk section 71 having substantially the same outer diameter as that of the press section 69 is provided at the extremity of each shaft section 70 of the second press roller 63. A plurality of step-like kick-feed sections 72 (four kick-feed sections in the drawing) are formed at a predetermined interval on the outer peripheral surface of the disk section 71. As shown in FIG. 6C, the kick-feed sections 72 radially project outward from the outer peripheral of the press section 69, and have the function of kick-feeding, toward the paper output tray 53, the rear end of the paper 3 having passed between the curl-straightening roller 61 and the second press roller 63.

As shown in FIG. 3, the holder 64 has a pair of right and left parallel side walls 74, and a pair of upwardly-open shaft-bearing grooves 75 are formed in the respective side walls 74. The shaft sections 70 of the first and second press rollers 62, 63 are fitted into the respective shaft-bearing grooves 75 with the press sections 69 of the respective press rollers 62, 63 being interposed between the side walls 74, so that the press rollers 62, 62 are rotatably held. A plurality of edge-shaped guide plates 76 are provided at positions on the holder 64 upstream of the first press roller 62 with respect to the transport direction of the paper 3, so as to follow the internal circumference of the paper output path 51. A pair of holder shafts 77 are formed at lower end positions on the guide plate 76 of the holder 64, so as to project to the right and left.

As shown in FIGS. 2 and 4, the paper output frame 67 has a tray section 79 constituting a rear portion of the paper output tray 53. A vertical wall 80 is provided at the rear end of the tray section 79. A plurality of plate-like inner guide sections 81, each having a substantially arc edge shape, are provided on the rear surface of the vertical wall 80 and side by side in a lateral direction. The inner guide sections 81 are provided along an inner circumferential side of the paper output path 51 and guide the transported paper 3. A horizontal wall 82 is formed on an upper rear surface of the vertical wall 80 so as to extend horizontally. Shaft bearing sections 83 are provided on the upper surface of the horizontal wall 82, and the holder shafts 77 of the holder 64 are pivotably retained by the shaft bearing sections 83. A stopper 66 is integrally provided at a position on the upper end portion of the vertical wall 80, the position corresponding to the holder 64, and a free end of the holder 64 is sandwiched between the stopper 66 and the curl-straightening roller 61. The holder 64 pivots around the holder shaft 77, to thus enable the press rollers 62, 63 to effect displacement so as to approach or depart from the curl-straightening roller 61. When the holder 64 is displaced over a predetermined distance in a direction in which the press rollers 62, 63 depart from the curl-straightening roller 61, the lower ends of both side walls 74 come into contact with the stopper 66, thereby regulating further displacement of the holder 64.

The spring member 65 is provided between the upper surface of the horizontal wall 82 and the holder 64. The free end of the holder 64 is forced upward, whereby the press rollers 62, 62 are pressed against the curl-straightening roller 61. When the paper 3 to be transported is a comparatively less-hard sheet material such as plain paper, the impelling force of the spring member 65 is set such that the spring member is resiliently displaced within a range where the holder 64 does not come into contact with the stopper 66. When the paper 3 is a comparatively hard sheet material, such as a cardboard, the impelling force of the spring member 65 is set such that the spring member comes into contact with the stopper 66 by the stress imparted by the paper 3.

Figure 7:
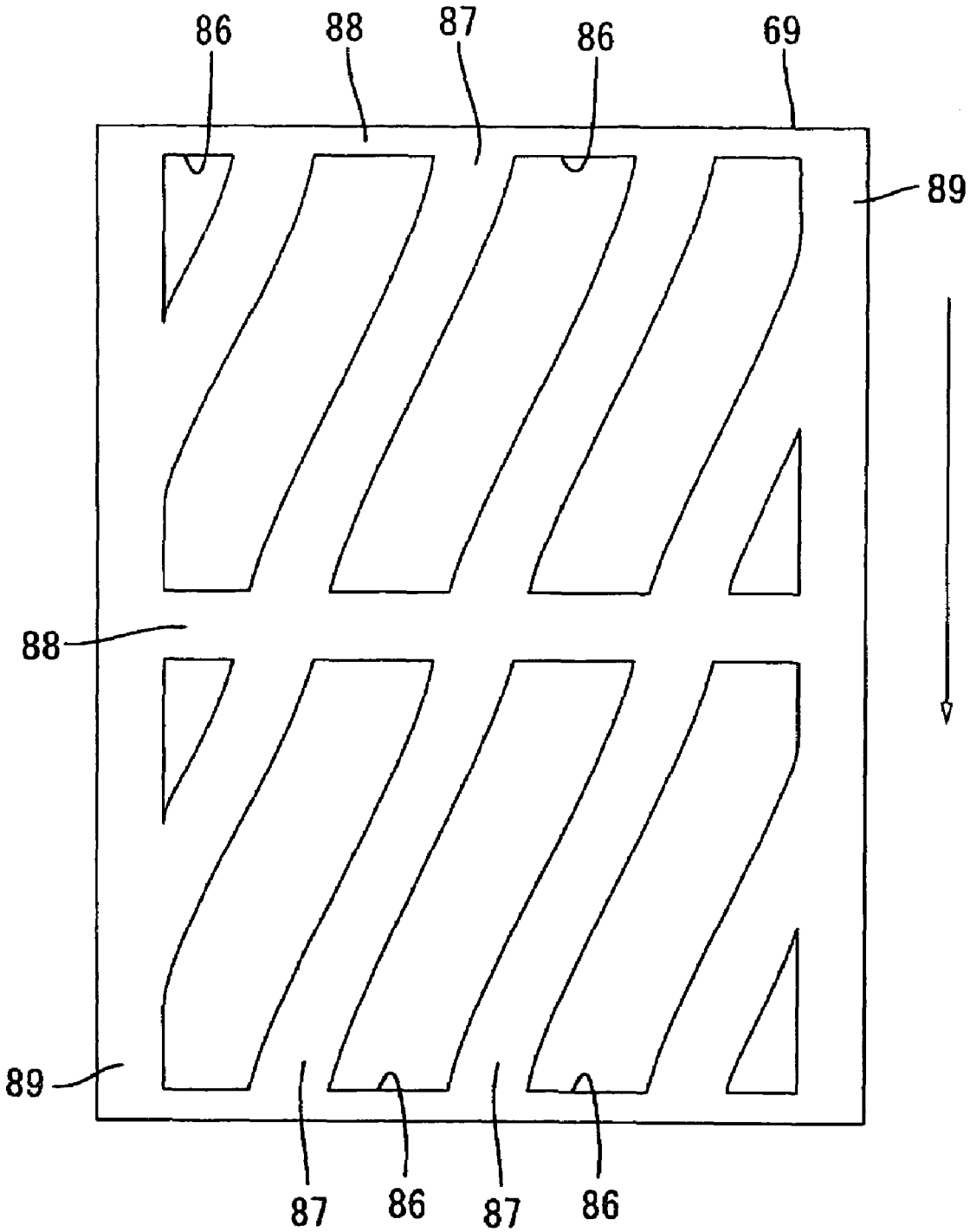
FIG. 7 is a developed view of an outer peripheral surface of the press section of the second press roller.

The groove sections 86 formed in the outer peripheral surface of the press section 69 of each of the press rollers 62, 63 will now be described. During the following description of the first and second press rollers 62, 63, the vertical and horizontal directions shown in FIG. 6A are taken as reference directions. Moreover, FIG. 7 is a developed view of the outer peripheral surface of the press section 69 of the second press roller 63.

As shown in FIG. 4, the press rollers 62R, 63R provided on the right of the main body casing 2 and the press rollers 62L, 63L provided on the left of the same are symmetrical with respect to the shape of the groove sections 86. In following the descriptions about the press rollers 62, 63, when there is a necessity for differentiating between right and left, the suffixes R and L are appended to the reference numerals.

The plurality of groove sections 86 are formed in a substantially-helical shape centered on the axis of the press section 69. The respective groove sections 86 are separated into areas corresponding to an upper surface and a lower surface, both belonging to the press section 69. In the respective upper and lower surfaces of the press section 69, the groove sections 86 are arranged in parallel to each other at given interval in the axial direction. Put another way, the groove sections 86 are formed to extend in a direction oblique to the circumferential direction (i.e., the transport direction of the paper 3) of the press section 69. A thread section 87, which has substantially the same helical pattern as that of the groove section 86, is provided between axially adjacent groove sections 86. Moreover, the groove sections 86 in the upper and lower surfaces are separated from each other by a pair of axially-extending separation sections 88. Side edge sections 89 are provided over the entire circumference of and on both end sections of the outer peripheral surface of the press section 69 in the axial direction (in the horizontal direction). The thread sections 87, the separation sections 88, and the side edge sections 89 are equal to each other with respect to the center axis of the press section 69 in terms of outer dimension, and their exterior surfaces act as areas which can come into contact with the paper 3. A taper 90 is formed in each of edges of the groove sections 86 (boundaries between the groove sections 86 and the thread sections 87, and boundaries between the separation sections 88 and the side edge sections 89). An area of the outer peripheral surface of the press section 69 opposing the curl-straightening roller 61 is located at the inside of both side edge sections 89 with respect to the axial direction.

Two types of extending directions are available for the groove sections 86. As shown in FIG. 4, the groove sections 86 of the press rollers 62R, 63R disposed on the right side with respect to the center of the paper 3 in the transverse direction thereof are provided so as to go toward the outside (rightward) of the paper 3 in the transverse direction thereof with increasing distance upstream in the transport direction of the paper 3 (the direction of the arrow in FIG. 7). The groove sections 86 of the press rollers 62L, 63L disposed on the left side are opposite in direction to the grooves 86 of the right press rollers 62R, 63R, and are provided so as to go to the outside (leftward) of the paper 3 in the transverse direction thereof with increasing distance upstream in the transport direction of the paper 3. The groove sections 86 of the first and second press rollers 62, 63 retained by the same holder 64 are identical in orientation.

The respective press rollers 62, 63 are formed by injection molding through use of a pair of molding dies (not shown) which are vertically separated from each other. On the assumption that the groove sections assume such a shape that the groove sections of the upper and lower surfaces of the respective press rollers 62, 63 form single lines, steps will arise in the edges of the groove sections located at the area where the upper and lower molding dies are to be combined together, for reasons of dimensional tolerance of the respective molding dies or a positional offset attributable to combination of the dies. The steps may adversely affect the paper 3. However, in the present embodiment, the separation sections 88 are provided at the position on the outer peripheral surface of the press section 69 where the upper and lower molding dies are combined together, thereby separating the groove sections 86. Hence, there is no chance of occurrence of the previously-described steps, and, hence, manufacture or positioning of the molding dies can be performed readily. When the molding dies are subjected to cooling and solidification after having been filled with synthetic resin, the groove sections 86 provided on the outer peripheral surfaces of the press rollers 62, 63 serve as built-up areas, which avoids occurrence of depressions.

Operation of the image forming apparatus of the present embodiment will now be described.

As previously described, the paper 3 on which is transferred a toner image is transported to the fusing section 21, and the image is thermally fused during the course of the paper 3 passing between the heating roller 49 and the press roller 50. However, during the fusing operation, there may be a case where a curl oriented toward the heating roller 49 arises in the paper 3. This curled paper 3 is transported to the curl elimination mechanism 60 by way of the paper output path 51.

The paper 3 transported to the curl elimination mechanism 60 is first nipped between the curl-straightening roller 61 and the first press roller 62. Next, the paper 3 is nipped between the curl-straightening roller 61 and the second press roller 63 and output to the paper output tray 53. When a common sheet material serving as the paper 3, such as plain paper, is transported, the press rollers 62, 63 press the paper 3 against the outer peripheral surface of the curl-straightening roller 61 by the restoration force of the spring member 65, whereby the paper 3 is warped in a direction opposite the direction in which the paper 3 has been curled by the fusing section 21. Thus, the curl of the paper 3 is eliminated.

When a firm sheet material, such as a cardboard or an OHP sheet, is transported as the paper 3, the press rollers 62, 63 are pushed down so as to depart from the curl-straightening roller 61 by the stress exerted by the paper 3, and the holder 64 is rotationally displaced so as to compressively deform the spring member 65. When the displacement of the holder 64 has reached a predetermined extent, the stopper 66 comes into contact with the holder 64, to thus regulate further displacement of the holder 64. As mentioned above, even when the firm sheet material is transported, the press rollers 62, 63 are not excessively separated from the curl-straightening roller 61, and hence the paper 3 can be always retained while being pressed against the outer peripheral surface of the curl-straightening roller 61. The curl is eliminated without fail.

Figure 8A:
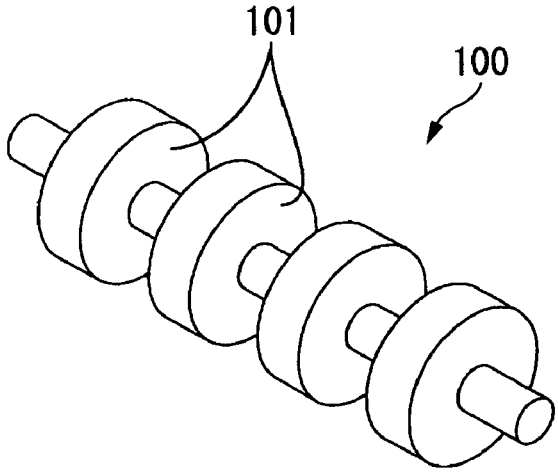
FIG. 8A is a perspective view showing a related-art roller.
Figure 8B:
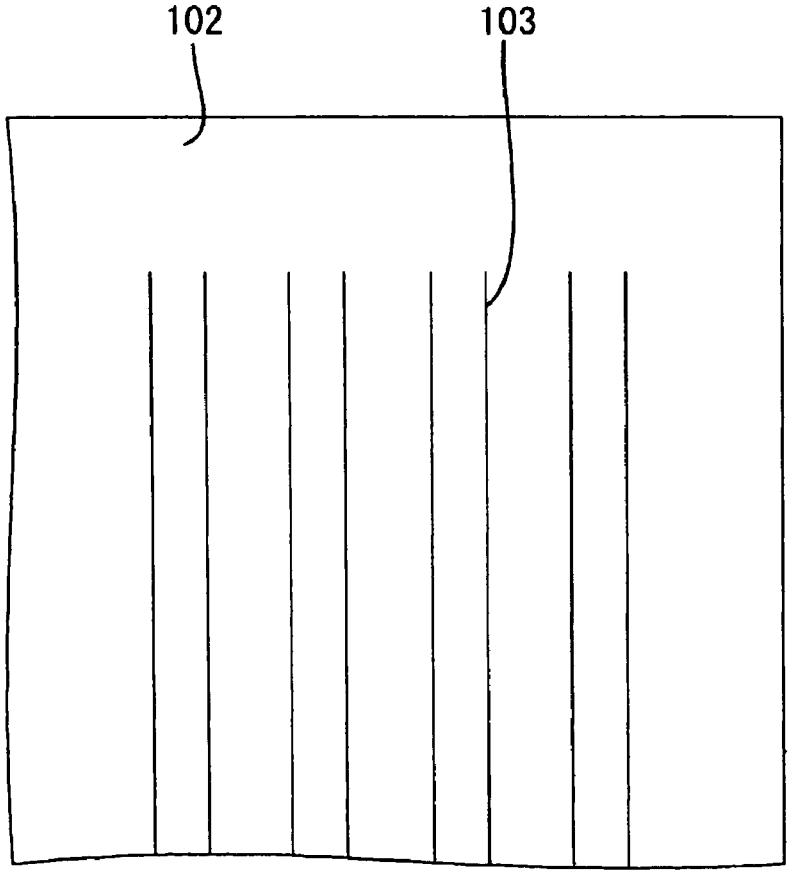
FIG. 8B is a fragmentary enlarged plan view showing a sheet material on which are left traces of the related-art roller.

As mentioned above, when the paper 3 passes between the first press roller 62 and the curl-straightening roller 61 or between the second press roller 63 and the curl-straightening roller 61, the outer peripheral surfaces of the press sections 69 of the respective press rollers 62, 63 are pressed against the paper 3. The paper 3 is transported in association with rotation of the respective press rollers 62, 63, and the positions of the groove sections 86 and those of the thread sections 87, both of which face the paper 3, are moved outward with respect to the transverse direction of the paper 3. As mentioned previously, in a case where groove sections 101 aligned in a circumferential direction are provided on the outer peripheral surface of the press roller 100 (see FIG. 8), there may arise a case where the traces 103 are left in paper 102. A conceivable reason for this is that wrinkles, such as those which bulge toward the inside of the respective groove sections 101 and are aligned in the transport direction, arise in the paper 102 during transport operation. In contrast, in the present embodiment, the groove sections provided in the outer peripheral surfaces of the respective press roller 62, 63 extend in the direction oblique to the transport direction of the paper 3. Hence, the paper 3 is less apt to develop wrinkles or traces responsible for the groove sections 86.

The paper 3 having passed through the curl elimination mechanism 60 is output to the paper output tray 53 as mentioned above. However, at this time, when the rear end of the paper 3 still remains on the second press roller 63 and fails to immediately fall on the paper output tray 53, the kick-feed sections 72 collide with the rear end of the paper 3, thereby causing the rear end of the paper 3 to fall on the paper output tray 53. Therefore, the paper 3 is stacked on the paper output tray 53 in good condition.

As mentioned above, according to the present embodiment, the groove sections 86 formed in the outer peripheral surfaces of the press rollers 62, 63 assume a shape extending in a direction a circumferential direction; that is, a direction oblique to the transport direction of the paper 3. Therefore, as compared with a case where the groove sections 86 are aligned in the paper transport direction, the paper 3 becomes less susceptible to traces of the groove sections 86. Moreover, as a result of the groove sections 86 being formed in the press rollers 62, 63, an attempt can be made to enhance dimensional accuracy or reduce the weight of the press rollers 62, 63.

The press rollers 62, 63 are made of synthetic resin and, hence, can be manufactured inexpensively.

Since the press rollers 62, 63 are made of synthetic resin through injection molding, they can be manufactured less expensively than when they are formed by another method, e.g., cutting or powder molding. Further, the groove sections 86 play the role of built-up areas, and hence dimensional accuracy can be ensured.

When the cross sectional profiles of the groove sections 86 orthogonal to the shafts of the press rollers 62, 63 are viewed, the groove sections 86 do not extend over the entire circumferences of the shafts. Therefore, occurrence of wrinkles in the transport direction of the paper 3 can be prevented without fail.

Since the groove sections 86 are formed in a substantially helical shape, the paper 3 is more smoothly transported when compared with a case where the groove sections assume, e.g., a meandering pattern.

The plurality of press rollers 62, 63 arranged side by side in the transverse direction of the paper 3 are laterally symmetrical with respect to the center of the paper 3 in the transverse direction thereof. Therefore, the force exerted by the press rollers 62, 63 uniformly acts on the right and left sides of the paper 3, whereby the paper 3 is transported in a straightened form without fail.

The groove sections 86 assume a shape which goes outside of the paper 3 with respect to the transverse direction thereof, with increasing distance upstream in the transport direction of the paper 3. Therefore, occurrence of wrinkles in the center portion of the paper 3 can be prevented without fail.

The curl elimination mechanism exhibits the function of eliminating a curl, and hence the force exerted on the rollers from the sheet material usually becomes greater than that arising in another transport mechanism. A great effect can be yielded by application of the grooved rollers 62, 63 of the embodiment of the present invention to such a curl elimination mechanism.

The pair of press rollers 62, 63 opposing the curl-straightening roller 61 are formed such that the groove sections 86 face the paper 3 in substantially the same direction. Hence, the paper 3 is less subjected to stress between the press rollers 62, 63, and hence the paper 3 can be transported more smoothly.

In a case where a curl in the firm paper 3, such as a cardboard, is straightened, if the press rollers 62, 63 are separated from the curl-straightening roller 61, the curl cannot be eliminated effectively. If the impelling force of the spring member 65 is set large in order to prevent occurrence of a failure to eliminate a curl, the less-firm paper 3 becomes susceptible to excessive stress. In contrast, according to the embodiment, when displacement of the holder 64 retaining the press rollers 62, 63 has reached a predetermined extent, further displacement of the holder 64 is regulated by the stopper 66. Therefore, the curl of the firm paper 3 can be straightened without fail unless the impelling force of the spring member 65 is increased. Accordingly, the impelling force of the spring member 65 is reduced to a small extent, and the stress exerted on the less firm paper 3 can be lessened.

Other Embodiments

The present invention is not limited to the embodiment described by the above description and the drawings. The following embodiment also falls within the technical scope of the present invention. Moreover, within the scope of the invention, the embodiments of the present invention can be carried out while being modified in a manner other than the following modifications.

(1) Although the above-described embodiment has illustrated application of the grooved rollers of the embodiments of the present invention to the press rollers, the grooved rollers of the embodiments of the present invention may be applied to a curl-straightening roller of a curl elimination mechanism or a roller other than the curl elimination mechanism. (2) Although the above embodiment has illustrated the grooved rollers made of synthetic resin, the grooved rollers may be made of, e.g., metal or rubber, according to the embodiments of the present invention. (3) Although the above-described embodiment has illustrated the grooved rollers made through injection molding, the grooved rollers may be formed by another method; e.g., cutting or powder molding.

(4) Although the above-described embodiment has illustrated the groove sections formed into a substantially helical pattern, the shape of the groove sections is not limited to the helical pattern according to the embodiments of the invention. The groove sections may assume a shape meandering in the axial direction of the roller.

What is claimed is:

1. An image forming apparatus comprising:

a roller that rotates around an axis of the roller to transport a sheet material contacting an outer peripheral surface of the roller, wherein the roller is formed from a grooved roller having a groove section that extends in a direction oblique to a circumferential direction of the grooved roller, wherein the grooved roller section is formed in an outer peripheral surface of the roller, and wherein the outer peripheral surface includes at least a first non-groove separation section extending parallel to the axis across an entire width of the roller.

2. The image forming apparatus according to claim 1, wherein the grooved roller is formed from synthetic resin.

3. The image forming apparatus according to claim 2, wherein the grooved roller is formed by injection molding.

4. The image forming apparatus according to claim 1, wherein the groove section is always given a shape which does not extend over an entire circumference of a cross sectional profile of the grooved roller which is orthogonal to the axis.

5. The image forming apparatus according to claim 1, wherein the groove section is formed into a substantially helical shape centered about the axis.

6. The image forming apparatus according to claim 1, wherein the grooved roller is arranged in a transverse direction of the sheet material, and wherein the groove section is symmetrically arranged on both sides about a center axis of a transverse direction of the sheet material.

7. The image forming apparatus according to claim 6, wherein the groove section is provided to head farther outside in relation to the transverse direction of the sheet material with increasing proximity to an upstream in a transport direction of the sheet material.

8. The image forming apparatus according to claim 1, further comprising:

a curl elimination mechanism that eliminates a curl of the sheet material; and at least one roller belonging to the curl elimination mechanism are formed from the grooved roller.

9. The image forming apparatus according to claim 8, wherein the curl elimination mechanism includes:

a curl-straightening roller to be rotationally driven; and a pair of press rollers being disposed opposite the curl-straightening roller, and the pair of press rollers being arranged to be respectively rotatable about different axes for transporting the sheet material along an outer peripheral surface of the curl-straightening roller while the sheet material is nipped between the curl-straightening roller and the pair of press rollers, wherein the pair of press rollers are formed from the grooved roller, and wherein the groove section of both press rollers is formed to be oriented in the same direction in relation to the sheet material.

10. The image forming apparatus according to claim 8, wherein the curl elimination mechanism includes:

a curl-straightening roller to be rotationally driven;

a pair of press rollers being disposed opposite the curl-straightening roller, and the pair of press rollers which transport the sheet material along an outer peripheral surface of the curl-straightening roller while the sheet material is nipped between the curl-straightening roller and the pair of press rollers;

a holder retaining the pair of press rollers, and the holder capable of being displacement in such a direction as to cause the press rollers to approach or depart from the curl-straightening roller;

a spring member impelling the holder in such a direction that the press rollers approach the curl-straightening roller; and a stopper capable of regulating displacement of the holder in excess of a predetermined range in a direction in which the press rollers depart from the curl-straightening roller.

11. The image forming apparatus of claim 1, further comprising a second non-groove separation section extending parallel to the axis across an entire width of the roller.

12. The image forming apparatus of claim 11, said first and second non-groove separation sections being located on opposite sides of the roller.

13. The image forming apparatus of claim 1, further comprising a non-groove edge section extending around an entire circumference of the roller and being perpendicular to the axis of rotation.

14. The image forming apparatus of claim 1, wherein said roller has an end edge forming a constant radius circular outer circumference when viewed axially.

15. The image forming apparatus of claim 1, further comprising an axial shaft extending axially beyond the roller.

16. An image forming apparatus comprising:

a sheet press roller having an axis of rotation and an outer peripheral surface, said outer peripheral surface including a plurality of grooves extending partially around the outer peripheral surface in a circumferential direction of the roller that is oblique to the axis of the roller, and a first non-groove portion extending parallel to the axis across an entire width of the outer peripheral surface of the roller.

17. The image forming apparatus of claim 16, further comprising a second non-groove portion extending parallel to the axis across an entire width of the outer peripheral surface, and located on an opposite side of the roller from the first non-groove portion.

18. The image forming apparatus of claim 16, wherein the non-groove portion extends around a circumference of the roller at opposing end edges of the roller.

19. The image forming apparatus of claim 16, wherein the roller further comprises an axial shaft extending beyond an end edge of the roller.

20. The image forming apparatus of claim 1, wherein said roller includes a plurality of kick-feed sections along its outer surface, wherein when the roller is viewed along its axis, the kick-feed sections project outward with a varying radius and form a step portion.

21. An image forming apparatus comprising:

a roller that rotates around an axis of the roller to transport a sheet material contacting an outer peripheral surface of the roller, wherein the roller is formed from a grooved roller having a groove section that extends in a direction oblique to a circumferential direction of the grooved roller, wherein the grooved roller section is formed in an outer peripheral surface of the roller, and wherein the outer peripheral surface includes at least two non-groove separation sections extending axially across an entire width of the roller, the two non-groove separation sections being disposed at symmetric positions opposite each other with respect to the axis of the roller.

22. The image forming apparatus according to claim 21, wherein the grooved roller is formed from synthetic resin.

23. The image forming apparatus according to claim 21, wherein the grooved roller is formed by injection molding.

24. The image forming apparatus according to claim 21, wherein the groove section is always given a shape which does not extend over an entire circumference of a cross sectional profile of the grooved roller which is orthogonal to the axis.

25. The image forming apparatus according to claim 21, wherein the groove section is formed into a substantially helical shape centered about the axis.

26. The image forming apparatus according to claim 21, wherein the grooved roller is arranged in a transverse direction of the sheet material, and wherein the groove section is symmetrically arranged on both sides about a center axis of a transverse direction of the sheet material.

27. The image forming apparatus according to claim 26, wherein the groove section is provided to head further outside in relation to the transverse direction of the sheet material with increasing proximity to an upstream in a transport direction of the sheet material.

* * * * *